United States Patent [19]

Angood et al.

[11] 4,251,580

[45] Feb. 17, 1981

[54] PILE SURFACED FRICTION DEVICE

[75] Inventors: Arthur C. Angood, Walldorf; Rodney E. Ginger, Oestringen, both of Fed. Rep. of Germany; Graham Jarrett, Hitchin, England

[73] Assignee: Imperial Chemical Industries Limited, London, England

[21] Appl. No.: 705,558

[22] Filed: Jul. 15, 1976

[30] Foreign Application Priority Data

Jun. 3, 1976 [GB] United Kingdom ..... 22951/76

[51] Int. Cl.[3] ..... B29C 17/02

[52] U.S. Cl. ..... 428/92; 428/85; 428/95; 428/97; 428/212

[58] Field of Search ..... 428/85, 92, 95, 212, 428/97; 264/88, 164

[56] References Cited

U.S. PATENT DOCUMENTS

| | | | |
|---|---|---|---|
| 3,390,403 | 6/1968 | Van Tilburg | 428/92 |
| 3,696,183 | 10/1972 | Steel | 264/164 |
| 3,701,621 | 10/1972 | Berglund | 425/115 |
| 3,708,565 | 1/1973 | Seiffert | 264/88 |
| 3,814,791 | 6/1974 | Jones | 264/164 |

*Primary Examiner*—Marion McCamish

*Attorney, Agent, or Firm*—Cushman, Darby & Cushman

[57] ABSTRACT

Laminer pile-surfaced material having piles on both outer surfaces, at least one pile having improved resistance to slide.

5 Claims, No Drawings

PILE SURFACED FRICTION DEVICE

The present invention relates to a method for improving friction between articles and friction devices therefor.

Friction devices such as mats used under cups and mugs on saucers and tables are usually made from compressed pulp in the form of tissue paper often with a water impermeable backing or of thin cardboard. Such mats suffer from a number of disadvantages and in particular they become soggy and lose their dimensional stability when wet. Further the mats slide often too easily on a polished surface and articles placed on the mats easily slide off the mats. This ease of slide is a major disadvantage where the mats are used in situations where there is vibration such as trains, aeroplanes and motor vehicles. The above mats are generally disposable items and only used once. More permanent are mats used for example to support flower pots on tables and glass table tops on for example as wooden table too. These mats are usually made from textile fabric felt, but glass tops can easily slide off such mats unless retaining clips are used to keep the glass top in place.

It has now been found that the resistance to slide of friction devices such as handles, gloves, shoes are increased markedly if they have a pile surfaced fabricated from a thermoplastic polyurethane.

According to the present invention a method is provided for improving the friction between two articles which comprises interposing between abutting surfaces of the articles a friction device which is provided with a pile surface fabricated from thermoplastic polyurethane on at least one of the surfaces of the device. The device may be interposed without adhesion to either article provided that the abutting surfaces of the articles are such that the device can naturally rest on one surface or may be secured to one abutting surface through the non-pile surface of the device. In a preferred embodiment, the device has a pile surface on both its surfaces and preferably both pile surfaces are fabricated from thermoplastic polyurethane.

In accordance with a further aspect of the present invention shaped friction devices are provided for the present method which have a pile surface fabricated from a thermoplastic polyurethane on at least one surface.

The devices of the present invention may be shaped by for example cutting to the desired shape and size from a sheet of pile-surfaced material to produce for example mats, gloves (particularly golf gloves) and conveyer belts. If devices having additional property are required the backing of the pile surfaced material may be laminated onto an additional backing of the same or different sheet as the backing of the pile-surfaced material.

In particularly preferred embodiments of the present invention shaped friction devices are provided for use with hands, feet or other parts of the body human or other animal where high coefficient of friction is required between that part and another object. Examples of such embodiments are handrails, shoes, socks for shoes, and gloves having external pile of polyurethane for facilitating friction grip to sports equipment e.g. golf clubs, badminton, squash and tennis racquets and cricket bats, hockey sticks, table tennis, baseball bats, lacrosse stick handles and to other items for example tools, steering wheels, bicycle handles, glassware, cooking utensils. In further embodiments, the above equipment is provided with a handle or hand or foot holds having a covering of product having a polyurethane pile, and also provided are shaped pieces for applying to handles or hand or foot holds on said equipment. However the present shaped devices and articles are not limited to those involving human or animal contact; other applications include vessel bases e.g. vases, table tennis bat playing surfaces, and other applications hereinbefore described.

The pile-surface may be pigmented and may be embossed or printed if required with for example a pattern or advertising matter.

Any suitable pile-surfaced material may be used in making the present mats although we find it most convenient to use a pile-surfaced material produced from a thermoplastic material according to the techniques described in British Pat. Nos. 1334672, 1378638, 1378639 and 1378640. In the techniques of these patents a laminar pile-surfaced material is formed by feeding a thermoplastic material and a backing to a heated surface with the thermoplastic material between the backing and the heated surface so that the thermoplastic softens and bonds to the backing as well as adhering to the heated surface so that the combination of the thermoplastic and the backing may be peeled away from the heated surface so that the thermoplastic is drawn into fibrils of fibres to provide a pile surface. In the present mats, at least one pile-surface is made from a thermoplastic polyurethane of the present invention the fibres or fibrils preferably have a length between 1 mm and 1 cm most preferably between 2 mm and 6 mm.

Whilst it is preferred that both surfaces of the present device have pile-surface made from the thermoplastic polyurethane other fibril forming thermoplastic materials which may be employed in the production of a pile-surfaced product for use on the second surface of the device according to the present invention include addition polymers, for example polymers and copolymers of ethylene, propylene, butadiene, vinyl chloride, vinyl acetate, vinylidene chloride, acrylonitrile and styrene and condensation polymers, for example polyamides and polyesters, e.g. of glycols and aromatic dicarboxylic acids. Blends of filament forming polymeric materials may also be used. As examples of specific themoplastic polymeric materials that may be employed we may mention polyethylene, polypropylene, nylon, polyethylene nylon, polyethylene terephthalate and polyvinyl chloride. Particularly preferred polymeric material is low density polyethylene.

The backing of the device on which the pile surface is formed may be of any suitable material as described in the above patent specifications but preferably the backing is of woven or non-woven material, or flexible or rigid cardboard but is most preferably water impermeable.

An account of the chemistry of polyurethanes (alternatively called polyurethans) is given on pages 56 to 106 of volume 21 of the second edition of the "Encyclopedia of Chemical Technology" edited by R E Kirk and D E Othmer and published by Interscience Encyclopedia. Polyurethanes are usually obtained by reacting an organic di-isocyanate or polyisocyanate with an organic diol or polyol, that is to say organic compounds containing two or more hydroxy groups which are capable of reacting with the di-isocyanate or polyisocyanate to form urethane (or urethan) groups. Most commercially useful polyurethanes are subsequently chain extended by reacting them with so-called "chain extenders" which are usually compounds containing hydroxy or amino groups which are capable of reacting with some or all of any unreacted isocyanate groups remaining in the non-chain extended polyurethane.

Thermoplastic polyurethanes which may, or may not, be chain extended, are normally made using only difunctional compounds (i.e. di-isocyanates, aliphatic diols and chain extenders containing only two groups such as hydroxy or amino groups). However they may be made using polyfuctional compounds, provided the polyfunctional compounds are not present in amounts which destroy the thermoplastic nature of the polyurethane obtained.

The thermoplastic polyurethane may be made by the so-called "one-shot" process in which one or more organic diisocyanates are reacted with one or more aliphatic diols of molecular weight greater than about 500 and optionally one or more chain extenders having a molecular weight or below about 500.

Alternatively the thermoplastic polyurethane may be made by the so-called "two-shot" process in which the diisocyanate and diols are reacted in advance to form a polyurethane which is subsequently chain extended.

Any such thermoplastic polyurethane may be used herein provided that it is capable of forming a pile-surfaced product.

Examples of organic diisocyanates that may be used to make the polyurethane include 2,4-tolylene diisocyanate, 4,4'-diphenylmethane diisocyanate, dianisidine diisocyanate, tolidine diisocyanate, m-xylylene diisocyanate, hexamethylene diisocyanate, dimethylenedicyclohexyl diisocyanate or the methyl or ethyl esters of lysine diisocyanate.

The aliphatic diols and polyols useful in making the polyurethanes preferably have molecular weights in excess of 800.

Examples of aliphatic diols that may be used include polyethers such as poly(oxypropylene)glycols, poly(oxypropyleneoxethylene) glycol block copolymers, or poly (1,4-oxybutylene) glycols. Other useful aliphatic diols include polyesters such as the polyesters of adipic acid with ethylene glycol, propylene glycol, 1,3-butane diol; 1,4-butane diol or copolyesters such as ethylene adipate/tetramethylene adipate copolyesters. Additional examples of diols are polymers and copolymers of epichlorohydrin, oxycyclobutane or substituted oxycyclobutanes and tetrahydrofuran, and also polyetherthioethers, such as the products of the self-condensation of thioglycols or the products of the condensation of thioglycols with glycols, and also polyacetals such as the reaction products of formaldehyde, acetaldehyde and butyraldehyde with dihydric alcohols such as propylene glycol, butylene glycols and diethylene glycol. Additional examples of polyester diols include the polyesters of succinic, glutaric, pimerlic, suberic, azelaic and sebasic acids with dihydric alcohols. Additional examples of dihydric alcohols include di-ethylene, dipropylene and trimethylene glycols, neopentyl glycol, pentamethylene glycol and hexamethylene glycol. The acid value of the polyesters should be desirably less than 6 and preferably less then 3. The most preferred polyesters have melting points below 60° C. and molecular weights between 1000 and 2500.

Examples of polyols include triols, tetrols and hexols such as the poly(oxypropylene) adducts of trimethyl propane, 1,2,6-hexanetriol or adducts of pentaerythritol or adducts of sorbitol. Other tetrols include the poly(oxypropylene-oxethylene) adducts of ethylenediamine.

Examples of chain extenders include ethylene glycol, 1,4-butane diol, the bis(2-hydroxyethyl)ether of hydroquinone, ethylene diamine, methylene-bis(o-chloroaniline), 1,2,6-hexanetriol or trimethylolpropane all of which are organic compounds containing active hydrogen. In some circumstances water may also be used as a chain extender.

Thermoplastic polyurethanes particularly useful in the performance of this invention include polyurethanes which are made by reacting a diisocyanate, e.g. 4,4'-diphenyl methane diisocyanate, with an aliphatic polymeric polyol of molecular weight above 800, e.g. a polyester or polyether such as poly (oxypropylene glycol), poly(ethylene adipate), poly(tetramethylene glycol), poly(ethylene adipate), or ethylene adipate/tetramethylene adipate copolyester, and then chain extending the reaction product with a diol of molecular weight less than 250, e.g. 1,4-butane diol. The polymeric polyol preferably has a $T_g$ (glass transition temperature) below 0° C.

The invention is illustrated with reference to the following Examples:

EXAMPLE 1

A pile-surfaced material was prepared as follows:

A sheet of brown wrapping paper, 90 $gm^{-2}$, was fed into a Kodak 15 TC glazing machine with a hot roll at 150° C. and a layer of low density polyethylene film (2 plies each 50 cm thick) was fed at the same rate between the paper and the hot roll. The contact time of the paper and film on the hot roll was approximately 30 seconds and during this time the paper and film were held in contact with the hot roll by pressure applied to an endless belt of resilient material. The paper sheet was parted from the hot roll and a blast of air directed at the side of the sheet of paper having firmly bonded to it a soft pile of polyethylene fibrils approximately 5 mm long.

A similar product was prepared from a thermoplastic polyurethane film but using a hot roll temperature of 250° C. The polyurethane was "Daltoflex" F 100 (Imperial Chemical Industries Limited) made from a polyester and 4.4'-diphenylmethane diisocyanate.

The coefficient of friction between two surfaces of the pile-surface product was measured by the test method described in British Standard 2782-311 A. In this method, the process required to overcome the frictional resistance between the two surfaces and the force (D) required to maintain smooth sliding at a constant rate and measure.

In this particular example the moving sled in the test method had weights 150 g to 350 g and a speed of 80 cm per minute.

For polyethylene/polyethylene D/S=1.48–1.44 whereas the figure for D/S for polyurethane/polyurethane was too high to be measured.

A beer mat was cut from the pile-surfaced materials and placed pile downwards on a glass surface.

A full liter beer mug was placed on the mats. On applying a sliding force to the beer mug, the mat having polyethylene pile-surface slid on the glass surface whereas that having the polyurethane pile-surface did not.

EXAMPLE 2

Pile surface materials were produced as described in Example 1 except that the backing was a thin woven cotton material (120 $gm^{-2}$) in place of the paper.

The materials were wrapped and secured onto handle of a squash racquet with the pile surface as the outer surface. A squash player found that the handle having polyethylene pile could not be gripped as securely as that having polyurethane pile. After 30 minutes active play, the polyethylene pile had a greasy feel and its handle could not be gripped securely; however the polyurethane pile had a much less greasy feel and provided a secure grip. The latter was found more satisfactory to an international squash player than a conventional towelling covered handle.

EXAMPLE 3

A piece of pile-surface material described in Example 2 was shaped and secured to both playing faces of a table tennis bat. The bat was found to be lighter and easier to handle than a bat having playing surfaces covered with conventional sponge rubber and spin applied to table tennis ball was found to be similar.

In a further example the bat handle was provided with a pile surface material having pile fabricated from thermoplastic polyurethane.

What we claim is:

1. A mat having piles on both outer surfaces, said piles being provided by laminar pile-surfaced material, at least one of which being a pile having improved resistance to slide and being fabricated from thermoplastic polyurethane, said laminar pile-surfaced material having a pile fabricated from thermoplastic material by feeding thermoplastic material and a backing to a heated surface so that the thermoplastic material softens and bonds to the backing as well as to the heated surface and then peeling the combination of thermoplastic material and the backing away from the heated surface thereby drawing the softened thermoplastic material in to fibres or fibrils to form a pile on the backing and cooling the fibres or fibrils as they are so formed.

2. A mat as claimed in claim 1 in which the piles on both outer surfaces are fabricated from thermoplastic polyurethane.

3. A mat as claimed in claim 1 in which the backing for the laminar pile-surfaced material is flexible.

4. A mat as claimed in claim 1 in which the fibres or fibrils forming the pile fabricated from thermoplastic polyurethane have length between 1 mm and 1 cm.

5. A mat as claimed in claim 1 in which the thermoplastic polyurethane is made from reacting polyester polyol with 4,4′ diphenylmethane diisocyanate.

* * * * *